US007762781B1

(12) United States Patent
Brown et al.

(10) Patent No.: US 7,762,781 B1
(45) Date of Patent: Jul. 27, 2010

(54) COMPOSITE BLADE AND PLATFORM ASSEMBLY

(75) Inventors: Wesley Brown, Jupiter, FL (US); Alfred P. Matheny, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 678 days.

(21) Appl. No.: 11/715,042

(22) Filed: Mar. 6, 2007

(51) Int. Cl.
*F01D 5/30* (2006.01)

(52) U.S. Cl. ..... 416/193 A; 416/2; 416/220 R

(58) Field of Classification Search ..... 416/193 A, 416/220 R, 221, 248, 2, 215, 216, 218, 219 R
See application file for complete search history.

(56) References Cited

U.S. PATENT DOCUMENTS

| | | | | | |
|---|---|---|---|---|---|
| 2,974,924 | A | * | 3/1961 | Rankin et al. | 415/173.7 |
| 2,997,274 | A | * | 8/1961 | Hanson | 416/140 |
| 4,019,832 | A | | 4/1977 | Salemme et al. | |
| 4,621,979 | A | | 11/1986 | Zipps et al. | |
| 4,650,399 | A | * | 3/1987 | Craig et al. | 416/97 R |
| 4,655,687 | A | | 4/1987 | Atkinson | |
| 4,719,080 | A | | 1/1988 | Duhl et al. | |
| 4,802,824 | A | | 2/1989 | Gastebois et al. | |
| 5,030,063 | A | * | 7/1991 | Berger | 416/220 R |
| 5,129,786 | A | * | 7/1992 | Gustafson | 416/209 |
| 5,161,949 | A | | 11/1992 | Brioude et al. | |
| 5,368,444 | A | * | 11/1994 | Anderson | 416/220 R |
| 5,415,526 | A | | 5/1995 | Mercadante et al. | |
| 5,464,326 | A | | 11/1995 | Knott | |
| 5,520,514 | A | | 5/1996 | Mareix et al. | |
| 5,611,669 | A | | 3/1997 | Royle | |
| 5,890,874 | A | | 4/1999 | Lambert et al. | |
| 6,077,615 | A | * | 6/2000 | Yada et al. | 428/544 |
| 6,132,175 | A | * | 10/2000 | Cai et al. | 416/220 R |
| 6,217,283 | B1 | | 4/2001 | Ravenhall et al. | |
| 6,632,070 | B1 | * | 10/2003 | Tiemann | 415/191 |
| 6,726,452 | B2 | | 4/2004 | Strassberger et al. | |
| 6,832,896 | B1 | | 12/2004 | Goga et al. | |
| 6,893,215 | B2 | * | 5/2005 | Kuwabara et al. | 415/139 |
| 7,094,021 | B2 | | 8/2006 | Haubert | |
| 7,163,376 | B2 | * | 1/2007 | Itzel et al. | 416/193 A |

* cited by examiner

*Primary Examiner*—Edward Look
*Assistant Examiner*—Ryan H Ellis
(74) *Attorney, Agent, or Firm*—John Ryznic

(57) ABSTRACT

A turbine blade and platform assembly in which the platform is a separate piece that is secured to the blade through shear pins that extend along slots formed between opposed abutting parts of the blade and the platform. Because the platform is detached from the blade, the blade can be made of a single crystal superalloy with a reduction in casting defects. The platform has one or more airfoil shaped openings or slots on the outer surface in which a blade is inserted. The shear pins are inserted to secure the platform to the blade. In another embodiment, the blade root is inserted into an opening formed in the rotor disk, and shear pins are inserted into slots formed in the root and the disk opening in order to secure the blade to the rotor disk. With this embodiment, the blade can be made of a ceramic material because only compressive forces are formed to hold the blade in place.

27 Claims, 4 Drawing Sheets

COMPOSITE BLADE AND PLATFORM ASSEMBLY

CROSS-REFERENCE TO RELATED APPLICATIONS

This application is related to a co-pending U.S. patent application Ser. No. 11/605,857 filed on Nov. 28, 2006 and entitled TURBINE BLADE WITH ATTACHMENT SHEAR INSERTS.

BACKGROUND OF THE INVENTION

1. Field of the Invention

The present invention relates generally to fluid reaction surfaces, and more specifically to a platform and blade assembly for use in a turbine of a gas turbine engine.

2. Description of the Related Art Including Information Disclosed Under 37 CFR 1.97 and 1.98

Rotor blades in an axial flow compressor or turbine used in a gas turbine engine have a rotor disk with a plurality of dove-tail or fir-tree slots formed in the disk in which a blade root having a similar cross section shape is placed in order to secure the blade to the rotor disk and hold the blade against the high centrifugal forces that develop during operation of the engine. The turbine blades typically include platforms that extend between adjacent blades and form an inner shroud for the gas flow through the blades. Stresses induced by the high rotor speeds concentrate at the fir tree slots and can be minimized by minimizing the mass of the blade.

Nickel base super-alloys are widely used in applications where high stresses must be endured at elevated temperatures. One such application is the field of gas turbine engines where nickel base super-alloys are widely used especially for blades and vanes. Demands for improved efficiency and performance have resulted in the operation of turbine engines at increasingly elevated temperatures placing extreme demands on the superalloy articles used therein.

One approach to improve the temperature capabilities of nickel based super-alloys is to fabricate the blades in the form of single crystals. Conventionally prepared metallic materials include a plurality of grains which are separated by grain boundaries which are weak at elevated temperatures, much weaker than the material within the grains. Through specific casting techniques, nickel based super-alloys can be produced in single crystal form which have no internal grain boundaries. U.S. Pat. No. 4,719,080 issued to Duhl et al on Jan. 12, 1988 and entitled ADVANCED HIGH STRENGTH SINGLE CRYSTAL SUPERALLOY COMPOSITIONS shows a prior art single crystal turbine blade, the entire disclosure of which is incorporated herein by reference. A single crystal blade will have higher strength in the radial direction of the blade which will result in better creep strength and therefore longer blade life.

Recent casting technologies have made the casting process for a single crystal blade at about the cost of casting a non-single crystal blade. However, casting process for single crystal blades produces a larger number of defective casts than does the non-single crystal casting process. This results in the casting process for the single crystal blades to be much higher. One major reason why this is so is that the single crystal blades are cast with the blade platforms formed with the airfoil portion. The platforms extend from the airfoil portion at substantially 90 degree angles from the blade spanwise direction. Since the single crystal orientation is along the spanwise direction of the blade (to provide for the higher blade strength and creep resistance), extending the single crystal growth of the blade airfoil out along the platform results in a lot of defects in the casting process. It would be beneficial to therefore from a single crystal blade with the platform formed separately in order to decrease the number of defective single crystal blades.

In some prior art turbine rotor disks used in gas turbine engines, the turbine blades have been formed from ceramic composites in order to allow for higher gas flow temperatures in the turbine section. The ceramic blades were formed with fir tree shaped roots for insertion in the fir tree slots of the metallic rotor disk. However, this manner of securing the blade to the rotor requires the blade root to be capable of withstanding high tensile forces. Ceramic materials are capable of withstanding high compressive forces, but not high tensile forces.

The prior art U.S. Pat. No. 5,030,063 issued to Berger on Jul. 9, 1991 and entitled TURBOMACHINE ROTOR discloses a rotor for an axial flow compressor or turbine in a gas turbine engine in which the rotor disk includes a plurality of fir tree shaped slots in which a turbine blade is secured within, and a ring that has airfoil shaped slots in which the blades extend through so that the ring forms a cylindrical platform for the gas flow through the blades in the assembled rotor disk. The ring an annular short flange and an annular long flange integral with the ring and on opposite sides of the cylindrical platform. The Berger invention separates the platforms from the blades so that the radial forces acting on the platform are transferred to the rotor disk instead of through the blades. However, in the assembly is used in the turbine section of a gas turbine engine, the extreme high temperatures would produce high thermal stresses on the annular flanges that would shorten the life of the ring. The lower edge of the annular long flange would be exposed to about 700 degrees C. while the upper edge would be exposed to about 1200 degrees C., resulting in a temperature gradient in this part of about 500 degrees C. which would cause very high thermal stresses in the part.

It is therefore an object of the present invention to provide for a turbine rotor disk with a single crystal blade with a platform formed as a separate attachment to the blade in which the thermal stresses would be acceptable for low cycle fatigue (LCF) and longer life.

It is another object of the present invention to provide for a turbine rotor disk with blades made from a single crystal superalloy with a lower number of defective blades made in the casting process.

It is another object of the present invention to provide for a turbine rotor disk in which the rotor blades are made from a ceramic material and attached to a rotor disk made from a metallic material, in which the ceramic blade is secured to the rotor disk and blade platforms through compression forces with very little tensile forces.

It is another object of the present invention to provide for a turbine rotor disk with blades made from a single crystal superalloy with a platform separate from the blade and secured to the blade through a shear pin that also provides for a seal between the airfoil and the platform against the hot gas flow.

BRIEF SUMMARY OF THE INVENTION

The present invention is a turbine blade with a platform separate from the blade but secured to the blade with shear retainer pins that curve along and follow the airfoil surface at the platform to blade interface. The separate platform includes a airfoil shaped slot in which the blade airfoil is inserted and positioned in place. The retainer shear pins are inserted to secure the platform to the blade. Each platform includes a pressure side edge and a suction side edge with slots for conventional inserts to seal adjacent platforms. Use of a separate platform allows for the blade to be made from a single crystal superalloy with low casting defects. A ceramic blade can also be used with the separate platform by using shear retaining pins to secure the ceramic blade root to a slot formed within the rotor disk.

DETAILED DESCRIPTION OF THE INVENTION

Figure 1:
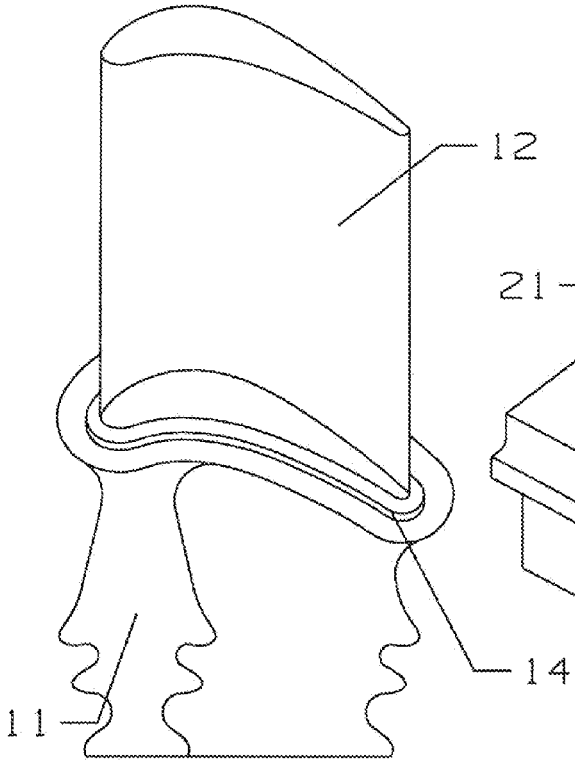
FIG. 1 shows a schematic view of a turbine blade without a platform of the present invention.

The present invention is a turbine blade with a platform that is used in a rotor disk of a gas turbine engine. The blades include platforms that form a flow path for the hot gas flow passing through the turbine blades. FIG. 1 shows a schematic view of the turbine blade of the present invention. The blade includes a root portion 11 that includes a standard fir tree configuration for placement within a slot of a rotor disk 41, an airfoil portion 12, and a platform edge portion 13 on both sides of the blade. The platform edge portion 13 includes shear pin slots 14 on both sides (the pressure side and the suction side) for receiving the shear pins 31 to be described below. In the preferred embodiment, the blade is made from a single crystal superalloy such as that described in U.S. Pat. No. 4,719,080 issued to Duhl et al on Jan. 12, 1988 and entitled ADVANCED HIGH STRENGTH SINGLE CRYSTAL SUPERALLOY COMPOSITIONS. Single crystal superalloy blades have higher strength than metallic blades, and thus improved creep resistance. This leads to longer blade life. However, the blade an be made of other materials such as nickel based superalloys.

Figure 2:
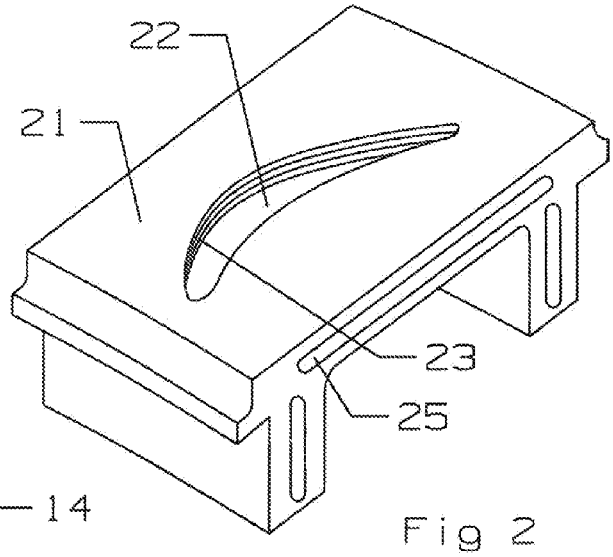
FIG. 2 shows a schematic view of a turbine blade platform of the present invention.
Figure 3:
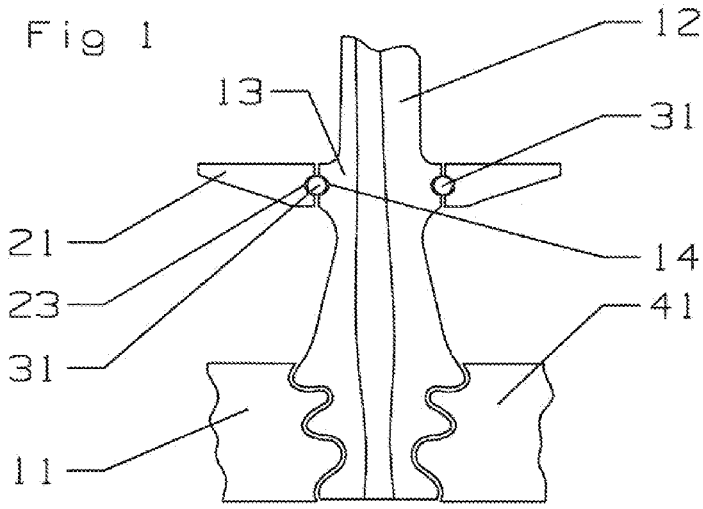
FIG. 3 shows a front cross section view of the blade and platform assembly of the present invention.
Figure 5:
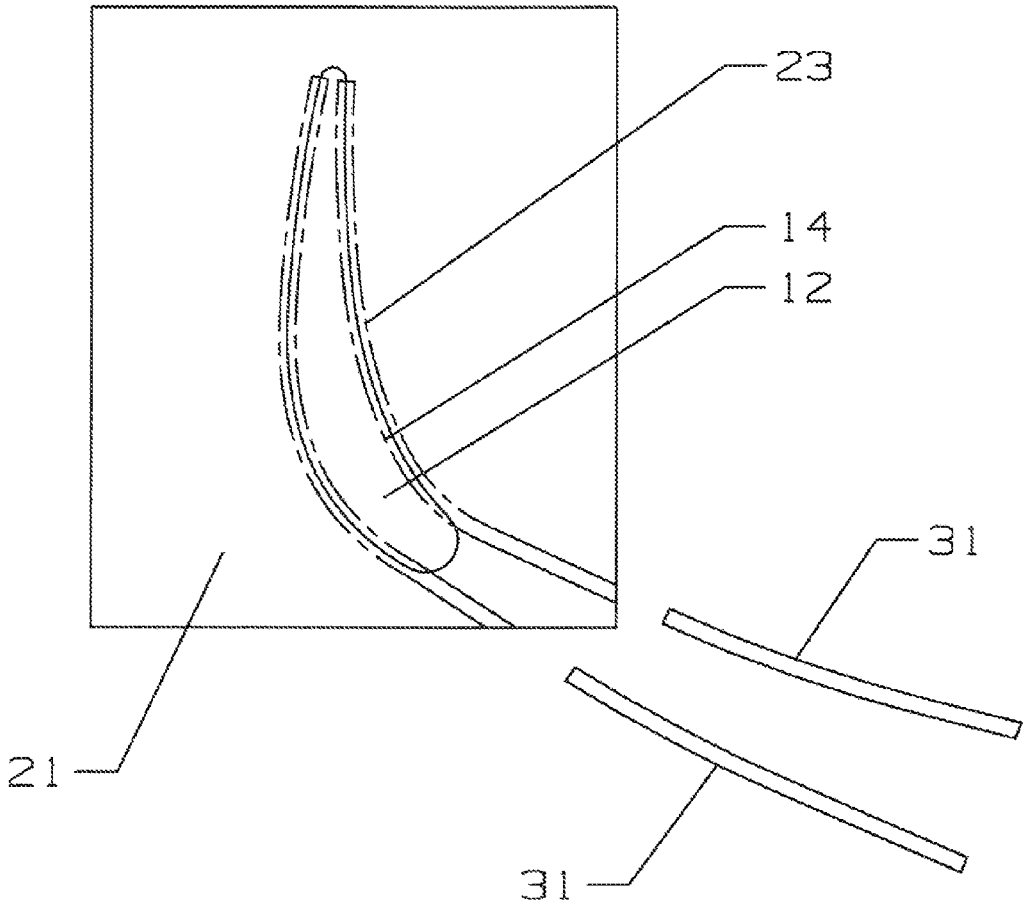
FIG. 5 shows a top view of the blade and platform shear pin groove arrangement of the present invention.
Figure 6:
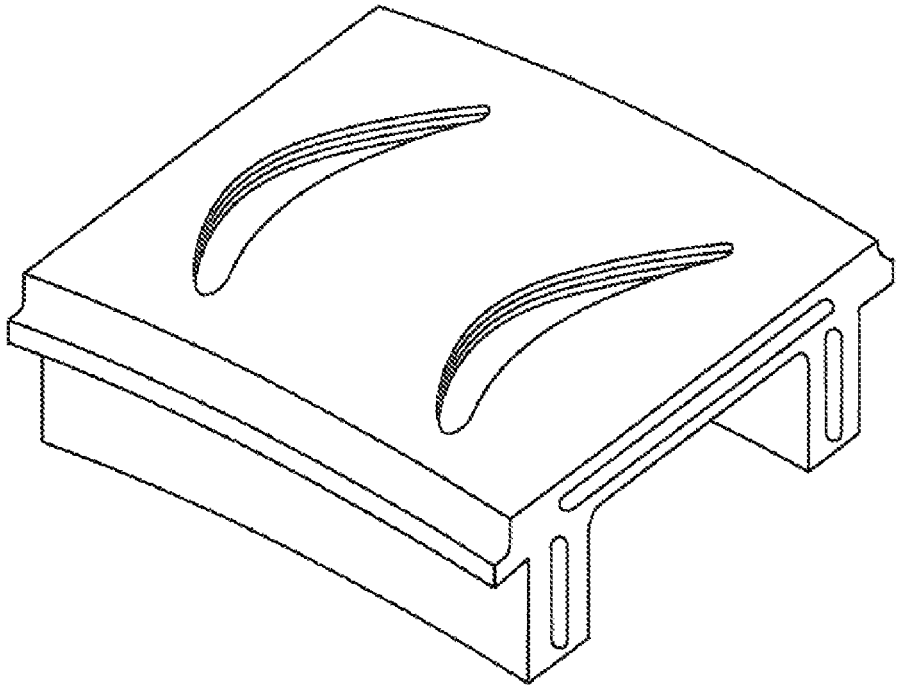
FIG. 6 shows a schematic view of an embodiment of the present invention with a one piece platform for more than one blade.

The separate platform 21 is shown in FIG. 2, and includes an airfoil slot 22 or opening in the top of the platform 21 and shaped to receive the airfoil 12 of the blade. Both sides of the slot 22 include shear pin slots 23 to receive the shear pins 31 described below. The pressure and suction sides of the platform also includes standard slots 25 to receive conventional seals to provide for a seal between adjacent platforms on the rotor disk assembly. The platform 21 can be made from a metallic or ceramic material depending upon the situation. FIG. 5 shows a top view of the platform 21 with the airfoil 12 of the blade located within the slot 22. The shear pin slots 14 and 23 are aligned when the blade is inserted into the platform slot 22, and two or more shear pins 31 are inserted into the slots 14 and 23 in order to secure the platform 21 to the blade. FIG. 3 shows a front view of a cross section of the assembled platform and blade in which the shear pin slots 14 and 23 are aligned, and the shear pins 31 are inserted to prevent radial displacement of the platform 21 from the blade. The shear pins 31 and the shear pin slots can be rectangular or circular in cross sectional shape. The platform is secured to the blade through the shear pins 31 against radial displacement due to the centrifugal forces that act during operation of the rotor disk assembly. The shear pins 31 also function to provide a seal between the spaces formed between the blade and platform. In the present embodiment, the platform 21 is shown to hold just one blade through s single airfoil slot 22. However, each platform can be extended in the circumferential direction and includes two or more airfoil slots 22 in order for a single platform to accommodate two or more blades. Having a single platform 21 with a plurality of blades would eliminate the seals required for the gaps between adjacent platform edges. FIG. 6 shows an embodiment in which a single piece platform is used to fit two airfoils for two blades.

For the assembly of the rotor disk, the platforms 21 are secured to the blades through the shear pins 31 first. Then, the blade and platform assembly is inserted into the slots of the rotor disk 41 in the conventional manner.

Figure 4:
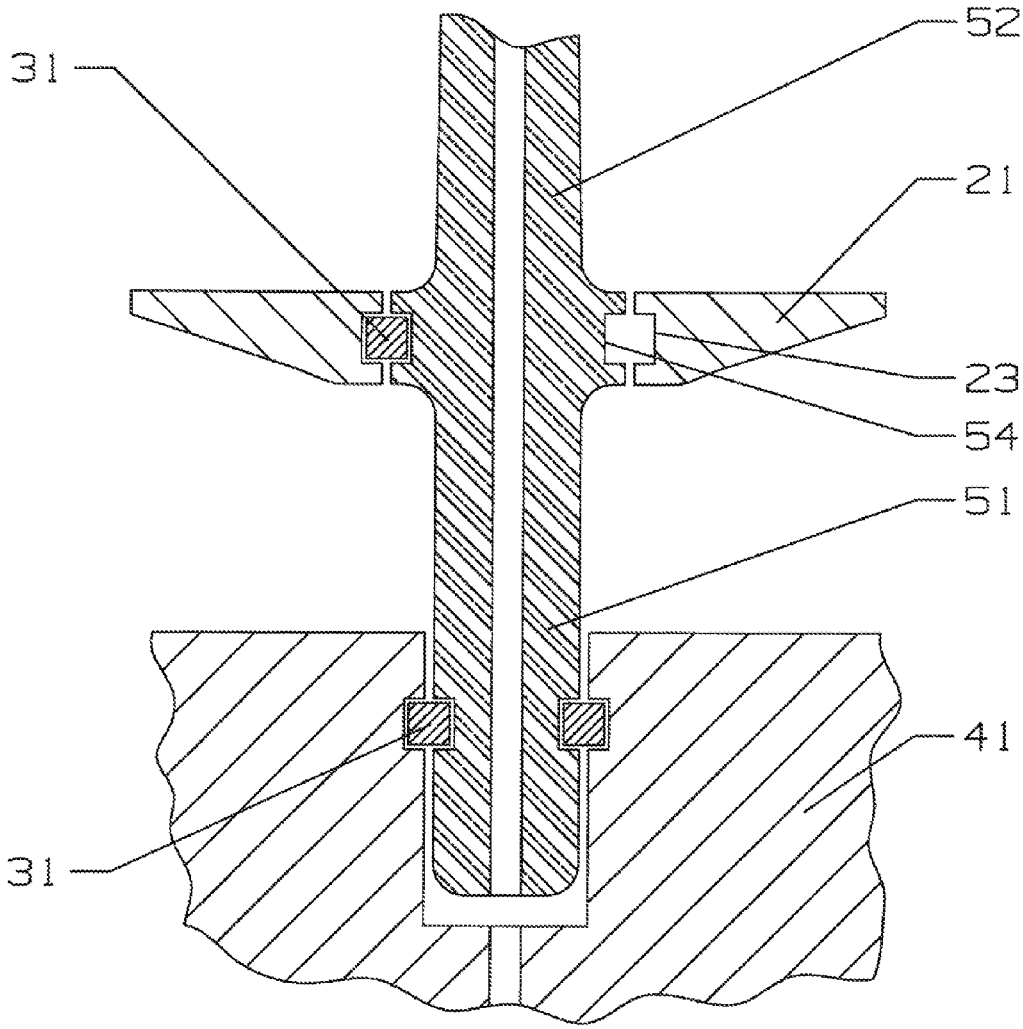
FIG. 4 shows a ceramic blade secured to a metallic rotor disk and a ceramic platform secured to the blade of the present invention.

FIG. 4 shows an additional embodiment of the present invention in which a ceramic blade can be secured to the rotor disk and to the platform using the shear pins of the present invention. Because the shear pins 31 and the slots formed in the two adjoining members, the ceramic blade will be under mostly compressive forces at the shear pin junction. No tensile forces are present. This is important for the use of a ceramic blade since a ceramic material can withstand high compressive forces but is weak in tensile forces. As such, the use of the conventional fir tree attachment in the slot of the rotor disk as used in the FIG. 3 embodiment will not be practical when a ceramic blade is used. The resulting tensile forces on the fir tree projections on the blade root would be too high for the ceramic material to withstand. Therefore, the use of a ceramic blade in a rotor disk can be practical with the use of the shear pin attachment structure shown in FIG. 4. The rotor disk 41 includes a slot for each of the blade roots 51 to fit within, and both of the blade root 51 and the rotor disk slot includes shear pin slots to receive a shear pin 31 to secure the blade root 51 against radial displacement with respect to the rotor disk 41. A platform 21 also includes shear pin slots 23 opposed to slots 54 in the airfoil portion 52 of the blade, and shear pins 31 are also used to secure the platform 21 to the blade as in the FIG. 3 embodiment. The root slots in the rotor disk are openings on the outer surface of the rotor disk in which the curved root portion of the blade will slide radially into for placement. The rotor disk slot and the blade root are sized and shaped so that the root is held in place against movement in all directions minus the radial direction. The shear pins 31 provide against the radial displacement. In the FIG. 4 embodiment, the blades are first inserted into the openings or slots formed in the rotor disk 41 and the shear pins 31 inserted to secure the blade to the rotor disk 41. Then, the platforms 21 are inserted over the airfoils of the blades and the shear pins 31 inserted to secure the platform 21 to the blade. As in the FIG. 3 embodiment, the platforms 21 in the FIG. 4 embodiment can have more than one airfoil slot 22 for the same reasons as in the above embodiment.

We claim:

1. A turbine blade for use in a gas turbine engine, the blade comprising:

a root portion having a fir tree configuration;

an airfoil portion extending from the root portion;

a platform edge portion formed between the airfoil portion and the root portion, the platform edge portion having a shear pin retaining slot extending substantially parallel to the blade chordwise direction;

a blade platform with an airfoil shaped slot formed therein, the airfoil slot having a shear pin retaining slot; and, a shear pin secured within the slots of the platform edge and the airfoil slot to secure the platform to the blade.

2. The turbine blade of claim 1, and further comprising:

the airfoil slot in the platform includes shear pin slots on the pressure side and the suction side of the slot; and, the blade platform edge portion includes shear pin slots on the pressure side and the suction side of the edge portions so that two shear pins secure the platform to the blade.

3. The turbine blade of claim 2, and further comprising:

the shear pin slots in the platform and the blade follow substantially the curvature of the airfoil at the junction to the platform; and, each of the two shear pin slots open onto a side of the platform to allow for the insertion of the two shear pins.

4. The turbine blade of claim 1, and further comprising:

the turbine blade is a single crystal superalloy.

5. The turbine blade of claim 1, and further comprising:

the platform includes a plurality of airfoil slots in order to secure a plurality of blades to the platform.

6. The turbine blade of claim 1, and further comprising:

the platform includes a pressure side edge and a suction side edge, each edge having a slot to receive a seal that provides a seal between adjacent platforms.

7. The turbine blade of claim 1, and further comprising:

the shear pin is the only means of connection to prevent radial displacement of the platform with respect to the blade.

8. The turbine blade of claim 1, and further comprising:

the shear pin is the only means of connection to prevent radial displacement of the platform with respect to the blade.

9. A turbine blade for use in a gas turbine engine, the blade comprising:

a root portion with a pressure side retaining slot and a suction side retaining slot to receive a shear pin to secure the blade to a slot in a rotor disk;

an airfoil portion extending from the root portion;

a platform edge portion formed between the airfoil portion and the root portion, the platform edge portion having a shear pin retaining slot extending substantially parallel to the blade chordwise direction;

a blade platform with an airfoil shaped slot formed therein, the airfoil slot having a shear pin retaining slot; and, a shear pin secured within the slots of the platform edge and the airfoil slot to secure the platform to the blade.

10. The turbine blade of claim 9, and further comprising:

the turbine blade is made substantially from a ceramic material.

11. The turbine blade of claim 9, and further comprising:

the airfoil slot in the platform includes shear pin slots on the pressure side and the suction side of the slot; and, the blade platform edge portion includes shear pin slots on the pressure side and the suction side of the edge portions so that two shear pins secure the platform to the blade.

12. The turbine blade of claim 9, and further comprising:

the shear pin slots in the platform and the blade follow substantially the curvature of the airfoil at the junction to the platform; and, each of the two shear pin slots open onto a side of the platform to allow for the insertion of the two shear pins.

13. The turbine blade of claim 9, and further comprising:

the platform includes a plurality of airfoil slots in order to secure a plurality of blades to the platform.

14. The turbine blade of claim 9, and further comprising:

the platform includes a pressure side edge and a suction side edge, each edge having a slot to receive a seal that provides a seal between adjacent platforms.

15. A turbine rotor having a rotor disk with a plurality of turbine blades extending radially therefrom, the blades including a platform extending between adjacent blades to form a gas flow path, the rotor comprising:

an opening in the disk to receive a blade;

each blade having a root portion with means to secure the blade root to the rotor disk;

each blade having a platform edge portion with a shear pin slot;

a platform with an airfoil shaped slot, the slot having a shear pin retaining slot therein; and, a shear pin secured within the slots of the platform and the blade to secure the platform to the blade in the radial direction.

16. The turbine rotor of claim 15, and further comprising:

the means to secure the blade root to the rotor disk is a fir tree configuration; and, the blade is made substantially from a single crystal superalloy.

17. The turbine rotor of claim 15, and further comprising:

the means to secure the blade root to the rotor disk is a shear pin retaining slot formed on the suction side and the pressure side of the root portion of the blade;

an opening formed in the rotor disk to securely fit the blade root, the opening having pressure side and suction side shear pin retaining slots; and, two shear pins inserted into the slots to secure the blade to the disk against radial displacement.

18. The turbine rotor of claim 17, and further comprising:

the turbine blade is made substantially from a ceramic material.

19. The turbine rotor of claim 15, and further comprising:

the platform includes a plurality of airfoil slots to receive a plurality of blades, each airfoil slot having a shear pin retaining slot to engage a shear pin with a blade to secure the platform against radial displacement with respect to the blade.

20. The turbine rotor of claim 15, and further comprising:

the platform includes a pressure side edge and a suction side edge, each edge having a seal slot to receive a seal that provides a seal between adjacent platforms.

21. The turbine rotor of claim 15, and further comprising:

the shear pin slots in the platform and the blade follow substantially the curvature of the airfoil at the junction to the platform; and, each of the two shear pin slots open onto a side of the platform to allow for the insertion of the two shear pins.

22. The turbine rotor of claim 15, and further comprising:

the platform includes a pressure side edge and a suction side edge, each edge having a slot to receive a seal that provides a seal between adjacent platforms.

23. A multiple piece turbine rotor blade comprising:

an airfoil section and a root section formed as a single piece from a single crystal superalloy material;

the root section having a fir tree configuration for securing the blade within a slot of a rotor disk;

a one piece platform having a slot in a shape of the airfoil such that the airfoil fits within the slot to minimize leakage, the platform having a pressure side platform and a suction side platform;

the one piece platform being made from a material different than the airfoil;

the airfoil and root section and the platform each having a slot opposed to one another; and, a shear pin secured within the slots of the platform and the airfoil and root slot to secure the platform to the airfoil and root section.

24. The multiple piece turbine rotor blade of claim 23, and further comprising:

both the pressure side and the suction side of the platform and the airfoil and root section have slots with a shear pin secured within both slots.

25. The multiple piece turbine rotor blade of claim 24, and further comprising:

the shear pin slots in the platform and the airfoil and root section follow substantially the curvature of the airfoil at a junction to the platform; and, each of the two shear pin slots open onto a side of the platform to allow for the insertion of the two shear pins.

26. The multiple piece turbine rotor blade of claim 24, and further comprising:

the platform includes a plurality of airfoil slots in order to secure a plurality of airfoil and root sections to the platform; and, the platform includes two slots for each airfoil and root section with one slot on the pressure wall side and the second slot on the suction wall side.

27. The multiple piece turbine rotor blade of claim 26, and further comprising:

the shear pin slots in the platform and the airfoil and root section follow substantially the curvature of the airfoil at a junction to the platform; and, each of the shear pin slots open onto a side of the platform to allow for the insertion of the shear pins.

* * * * *